United States Patent [19]

DeWan

[11] 4,404,689

[45] Sep. 20, 1983

[54] FLEXIBLE CONTAINER

[76] Inventor: Thomas E. DeWan, 1210 E. Oakwood St., Tarpon Springs, Fla. 33589

[21] Appl. No.: 219,138

[22] Filed: Dec. 22, 1980

Related U.S. Application Data

[63] Continuation-in-part of Ser. No. 175,135, Aug. 4, 1980, abandoned.

[51] Int. Cl.[3] ..... A41D 27/20; A41D 3/08; A41D 1/00

[52] U.S. Cl. ..... 2/247; 2/94; 2/88

[58] Field of Search ..... 2/88, 84, 93, 108, 94, 2/243

[56] References Cited

U.S. PATENT DOCUMENTS

| | | | |
|---|---|---|---|
| 2,143,931 | 1/1939 | Aronson | 2/93 |
| 2,292,347 | 8/1942 | Bailey | 2/93 |
| 2,324,722 | 7/1943 | Papierniak | 2/93 |
| 2,325,494 | 7/1943 | Fayer | 2/93 |
| 2,513,074 | 6/1950 | Wolf | 2/84 |
| 2,825,902 | 3/1958 | Breier | 2/93 |
| 2,959,789 | 11/1960 | Mills et al. | 2/93 |
| 2,971,198 | 2/1961 | Tomich | 2/84 |
| 3,085,254 | 4/1963 | Cutler | 2/243 |
| 4,060,852 | 12/1977 | Meek | 2/84 |
| 4,064,562 | 12/1977 | Kenny | 2/84 |

FOREIGN PATENT DOCUMENTS

| | | | |
|---|---|---|---|
| 815934 | 10/1951 | Fed. Rep. of Germany | 2/85 |

*Primary Examiner*—Doris L. Troutman
*Attorney, Agent, or Firm*—Jones, Tullar & Cooper

[57] ABSTRACT

A flexible container for an article constructed in accordance with a predetermined three-dimensional shape which represents the reproduction of a desired item is now being added to the state-of-the-art. The container while being flexible is also self-sustaining so that it can retain its predetermined three-dimensional shape without the assistance of any external agent. The flexible container is stored with the article when it is not serving as a container for the article. The predetermined three-dimensional shape which the flexible container assumes when it is to serve as a container for the article is relinquished when stored with the article so as not to interfere with the intended use of the article.

15 Claims, 13 Drawing Figures

FLEXIBLE CONTAINER

CROSS-REFERENCE TO RELATED APPLICATION

This application is a continuation-in-part application of Application Ser. No. 175,135, filed Aug. 4, 1980 now abandon.

BACKGROUND OF THE INVENTION

1. Field of the Invention

This invention relates to flexible containers for articles, and more particularly to flexible containers for articles, where the flexible containers are constructed in accordance with a desired predetermined three-dimensional shape.

2. Prior Art

The flexible container which forms the subject matter of this application should possess self-sustaining characteristics and assume a predetermined three-dimensional shape for receiving an article. In this respect it is to be distinguished from flexible containers which are not self-sustaining such as commercial bread wrappers, and the like. These flexible containers only maintain their shape because of the contents which they cover. The flexible container according to the invention may or may not serve a supportive function, i.e., it may or may not support the article with which it is to be associated. It will, however, encompass the article when the article is not to be used for its intended purpose.

The applicable areas to which the present invention pertains are many. One such area is that of wearing apparel.

Various methods and means have been utilized in the prior art for storing wearing apparel such as flexible jackets, shirts, pants, swimming suits and the like in small bags or pouches. In general, the flexible garmet is stuffed into a separate bag or pouch for easy carrying by the owner. Unfortunately, the owner may forget to take the separate pouch or the bag becomes lost or separated from the garment. Accordingly any benefit of having a separate pouch is lost by the owner.

Some in the prior art have utilized a pocket in the garment for simultaneous use as an internal pocket and for use as a carrying pouch. This type of arrangement has been utilized in lightweight jackets and the like, to eliminate the need for a separate and distinct carrying pouch.

Many of the lightweight jackets heretofore mentioned are used for various sports activities or commercial promotion or premium items. For example, many of these items are directed to very specific sports or athletic teams or a variety of commercial products or organizations too numerous to mention. In general, indicia of such commercial products, organizations or sports events are applied to the outer surface of the jacket for promotional considerations.

OBJECTS AND SUMMARY OF THE INVENTION

An object of the invention is to provide a flexible container for a wide variety of articles which has self-sustaining, three-dimensional characteristics;

It is a related object of the invention to provide a flexible container such as that noted in the previous stated object which is attached to the article, and, upon assuming a predetermined shape serves to enclose the article;

It is a related object of the invention to provide a flexible container such as that noted in the previous stated objects according to which the predetermined shape is not only three-dimensional, but represents the reproduction of a desired item.

It is a related object of the invention to provide a flexible container such as that noted in the previous stated objects where the article is a garment and the flexible container is adaptable to various types of garments including jackets, pants, swimsuits, hats, shirts and the like;

It is a related object of the invention to provide a flexible container such as that noted in the previous stated objects where the flexible container utilizes indicia on the outer surface of the garment and the inside surface of the flexible container such that the indicia and the shape of the flexible container have a common subject matter; and It is a related object of the invention to provide a flexible container such as that noted in the previous stated objects where the flexible container is an effective promotional item that can be manufactured without any additional cost to the consumer.

These objects are achieved by a flexible container for an article which is stored with the article when it is not serving as a container for the article. The container is constructed in accordance with a predetermined three-dimensional shape, which it assumes when it serves as a container for the article and relinquishes when stored with the article so as not to interfere with the intended use of the article.

The construction sequence need not be restrictive to a single procedure. For example, the container can have one or more pieces joined together to form the container. The manner of joining the pieces and the means of joining the pieces are arbitrary. What the construction must achieve is a predetermined, self-sustaining three-dimensional shape which encompasses a volume sufficient to accomodate the article without requiring any other external agent to reach the noted volume.

The three-dimensional shape represents a reproduction of a desired item and its shape. For example, the container can be reproduction of a football when the article is a parka to be worn at a football game, it can be the reproduction of a rock when the article is a military vehicle such as a jeep.

Regarding the garment aspect of the invention, the distinctive pattern of the flexible container comprises at least one curved seam and has at least one seam or portion thereof that travels in a direction other than in an X-Y flat plane, thus a third dimension is actually constructed into the container before it is stuffed with the garment.

In more specific embodiments of the garment aspect of the invention, the flexible container is a pocket within the garment with the closure being a zipper of the pocket. The garment is stored in the pocket by turning the pocket inside out and stuffing the flexible garment within the pocket. The zipper has preferably a double-sided zipper slider for operating as a conventional zipper when the pocket is used conventionally and for closing the garment within the flexible container when the pocket is inside out. The flexible container or pocket is typically made of the same material as the flexible garment enabling ready manufacture of the item. The flexible container may be made of a different color or different material, depending on the particular application.

The distinctive three-dimensional shape of the container is specifically a commercial product or other subject or object. Indicia may be disposed on the outer surface of the garment relating to the specific subject. Likewise, the distinctive three-dimensional shape would have the specific subject matter as the indicia on the outside of the jacket. An optional indicia disposed on the flexible container also relates to the specific subject disposed on the outer surface of the garment.

A carrying strap or waistband may be incorporated by fastening to the outer surface of the flexible container. This enables the carrying strap or waistband to be contained within the pocket while the jacket is used in a conventional fashion and for extending outwardly upon turning the pocket inside out to once again form the flexible container and subsequently contain the flexible garment.

While the invention has application beyond garments, the preferred embodiments will be discussed with regard to garments only.

DETAILED DESCRIPTION OF THE PREFERRED EMBODIMENTS

Figure 1:
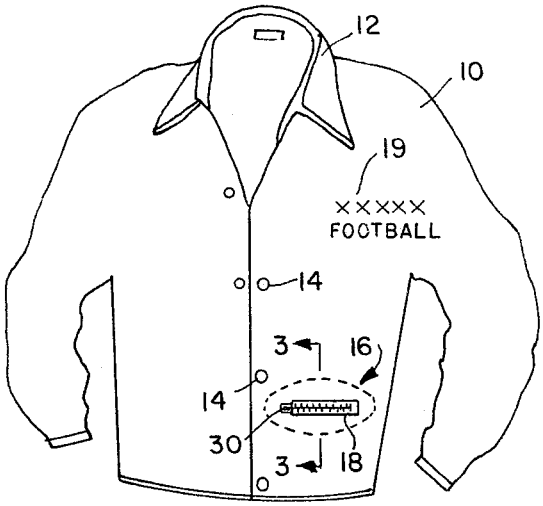
FIG. 1 is an elevational view of the flexible garment with a container according to the present invention.

FIG. 1 is a front elevational view of a flexible garment shown as a jacket 10 incorporating a collar 12, snap fasteners 14 and a flexible container 16 having a closure shown as zipper 18. It should be understood that the snap fasteners 14 are merely presented for the sake of clarity and form no portion of the invention. Similarly, the zipper 18 is only a specific embodiment of the closure and many other means such as laces, snaps, "VELCRO" or the like may be utilized in this invention. The jacket 10 is preferably made of a flexible lightweight material which may be readily stuffed into a container.

Figure 2:
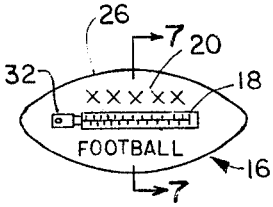
FIG. 2 is an elevational view of the flexible container enclosing the garment of FIG. 1.

FIG. 2 illustrates the result of the garment 10 being stuffed into the flexible container 16. The container in this case assumes a distinctive three-dimensional shape of a football. The garment 10 includes indicia 19 indicating a specific football team which is identical to the indicia 20 located on the outside surface of the flexible container 16. Accordingly, the subject matter of the indicia 19 appears in the indicia as well as in the distinctive shape of the flexible container 16.

The garmnt aspect of the invention relates to the presentation of a distinctive shape of an object such as a commercial or promotional item or subject matter. The enclosed examples of the invention show only a few of the variety of applications of the invention and it should be appreciated that the invention should not be considered to be limited by the disclosed embodiments.

FIGS. 3–7 show the flexible container 16 in greater detail so the present invention may be better understood. The flexible garment 10 is sewn to a first side 21 of zipper 18 having teeth 21A for engagement with a second side 22 of the zipper 18 having teeth 22A. The flexible container 16 comprises a distinctive pattern of four forming pieces of material 24 having a plurality of seams 26 to create the three-dimensional shape as heretofore mentioned. In the embodiment shown in FIGS. 1–7, all of the seams 26 are curved to provide the desired reproduction of a football shape. The garment 10, zipper sides 21 and 22 and the container material 24 may be simultaneously sewn by threads 28. The zipper 18 preferably has a double-sided zipper slider 30 and 32.

Figure 3:
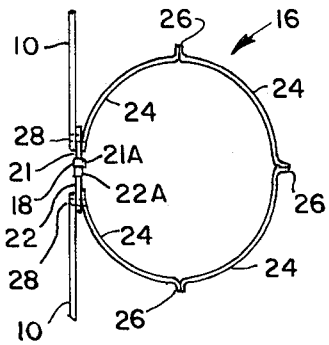
FIG. 3 is an enlarged sectional view along line 3—3 of FIG. 1.

FIG. 3 illustrates a side sectional view of the garment 10 with the flexible container 16 being shown in an extended position as if inflated. This shape of the flexible container 16 is assumed because of its construction and not as a result of the garment 10 being inserted into the container. The flexible container 16 is self-sustaining. It will maintain the shape shown independent of any external agent. Nevertheless, it will collapse, due to its flexibility, toward the garment 10 under the influence of forces which are exerted when the garment is put on by the wearer so that it does not interfere with the wearing of the garment.

Figure 5:
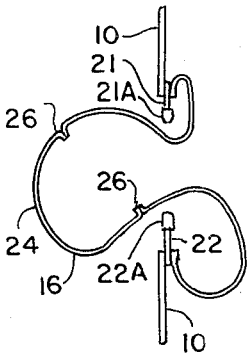
FIG. 5 is a side sectional view showing the first step of turning the flexible container inside out.

FIG. 5 illustrates a first step of introducing the garment 10 into the flexible container 16. This Figure shows a portion of the flexible container 16 being pulled outside of the garment and turned inside out as shown by seams 26 being disposed on the inside of the container 16 to provide a clean appearance to the filled container 16.

Figure 6:
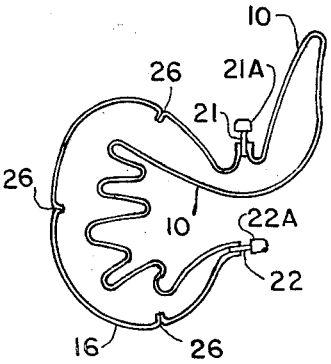
FIG. 6 is a side sectional view showing s second step of turning the flexible container inside out and stuffing the garment therein.

FIG. 6 shows the continuation of the stuffing of the garment 10 within the flexible container 16 with only a portion of the garment 10 extending outside. It should be appreciated that the entire garment would completely fill the container 16, but this has not been shown for the sake of clarity.

Figure 4:
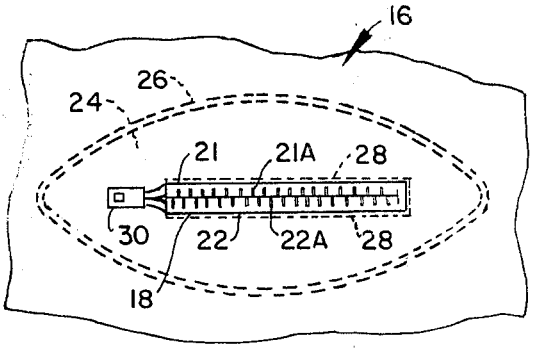
FIG. 4 is an enlarged view of the zipper of FIG. 1.
Figure 7:
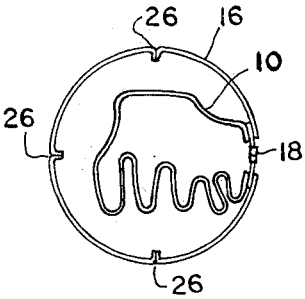
FIG. 7 is a side sectional view showing the closing of the flexible container containing the flexible garment along line 7—7 of FIG. 2.

FIG. 7 illustrates the final step in the containment of the garment 10 wherein the zipper sections 21 and 22 are closed establishing the flexible container 16 in the football shape shown in FIGS. 1, 2 and 4.

Figure 8:
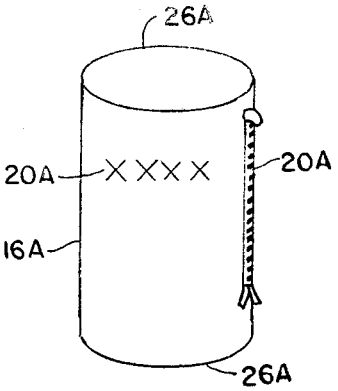
FIG. 8 illustrates a second specific embodiment of the distinctive shape of the flexible container.

Now that the garment aspect of the invention has been presented with respect to a particular garment, it should be obvious to those skilled in the art that this aspect of the invention may find application in various types of garments in addition to having various distinctive shapes of flexible containers. The remaining FIGS. 9–13 show a few examples of the shape of flexible containers for other garments. FIG. 8 illustrates a cylindrically shaped flexible container 16A having indicia 20A which may be representative of a beverage or other similar product contained in a can.

Figure 9:
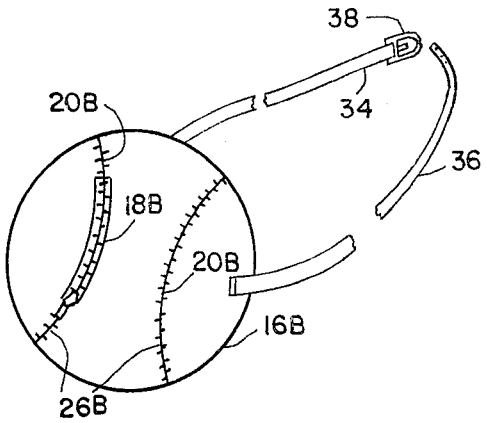
FIG. 9 illustrates a third specific embodiment of the distinctive shape of the flexible container.

FIG. 9 illustrates a flexible container 16B with the shape of a baseball with the indicia 20B being the seams of a baseball. The indicia 20B may be applied by silk screening or similar process. In this embodiment, the zipper 18B is disposed within a portion of the indicia 20B to make the flexible container seem more realistic. A carrying strap or a waistband comprises sections 34 and 36 which are fastened to the outer surface of the flexible container 16B. A fastener 38 is used for interconnecting strap sections 34 and 36 to form the carrying strap or waistband. It should be appreciated that the straps 34 and 36 will be contained within the flexible container 16B when the container is disposed as shown in FIGS. 1 and 3.

Figure 10:
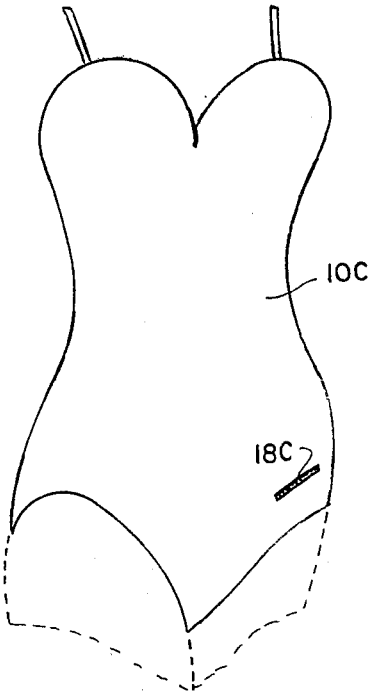
FIG. 10 illustrates a bathing suit utilizing the invention.

FIG. 10 illustrates a garment 10C shown as a bathing suit incorporating a zippered pocket 18C. In this embodiment, the flexible container has the shape of lips 16C in FIG. 11 with the zipper 18C being disposed on the lips as shown. It should be understood that the invention may be utilized with either a single or two-piece bathing suit.

Figure 12:
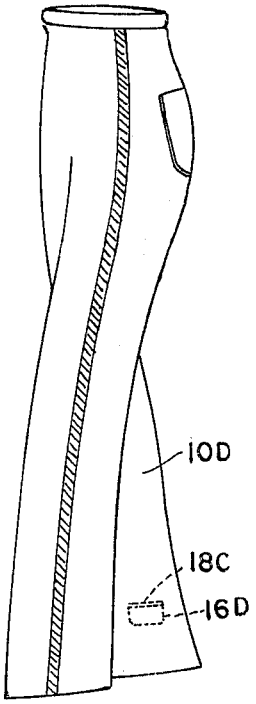
FIG. 12 illustrates pants utilizing the invention.
Figure 11:
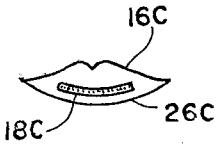
FIG. 11 illustrates a distinctive shape which may be utilized for containing the bathing suit shown in FIG. 10.

FIG. 12 illustrates pants utilizing a concealed container which is not a pocket as in the prior embodiments. In this embodiment, the garment 10D contains a concealed flexible closure 16D having a zipper 18D for containing the garment. The flexible container may take any distinctive shape. The flexible container may be of a size sufficient to contain another associated garment such as a shirt, hat or the like.

Figure 13:
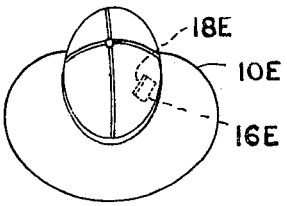
FIG. 13 illustrates a hat incorporating the present invention.

FIG. 13 illustrates a garment shown as a hat 10E incorporating a concealed container 16E utilizing a VELCRO fastener 18E. This device operates in a manner similar to that heretofore described.

The following has described a novel and unique system whereby an integral carrying container on a garment may assume a predetermined three-dimensional shape which is a reproduction of a desired item. In addition to the prior shapes, the following shapes are also possible: tire, blimp, shock absorber, boat muffler, animal, portion of a human body such as a heart or ear, a vegetable or fruit. An important feature is that the container be constructed so that it will assume the desired shape and be self-sustaining as well. The container must also be flexible for storage or when it is not being used as a container. It can be constructed using a plurality of pieces joined together as discussed above with reference to FIGS. 1–7, or it can be a single extruded piece, for example.

Referring to the utilization of the invention as noted on Page 5 regarding the use of the container with a jeep, the flexible container would be constructed in the shape of a rock as an example. The container could be stored within the bumper of the jeep or within the tire well or framework of the vehicle.

Another example of the self-sustaining three-dimensional container would be a coffee cup container stored within the handle of the cup which when containing the cup itself would form the shape of the die. Another example would be a self-sustaining three-dimensional eyeglass container in the shape of a measuring ruler having indicia showing inch marks or the shape of a candy bar wrapper. This container could be stored within the ear piece of the eye glasses. Another example would be a container for firearms which would store within the handle or stock of the firearm and which would, in use, contain the firearm in the shape of a box.

Another example would be a container for pillows which could be in the shape of animals or balls. In some instances for the purpose of enhancing the appearance and to form a more faithful reproduction of the intended appearance of the self-sustaining container, the use of certain collapsible foam materials such as Nerf-ball foam or inflatible areas, within the container itself, may be desirable.

What I claim is:

1. A three-dimensional flexible container for an article which is complete and functional apart from the container, comprising:

at least one flexible forming piece encompassing a volume by construction and defining thereby a predetermined shape which is continuous and self-sustaining, and which represents the reproduction of a desired three-dimensional item, the function of which is unassociated with the function of a container;

said flexible container being attached to the article and, upon assuming its predetermined shape, being adaptable to enclose the article.

2. The three-dimensional flexible container as defined in claim 1, wherein the flexible container forms part of the article.

3. A three-dimensional flexible container for a flexible garment which is complete and functional apart from the container, comprising:

at least one flexible forming piece encompassing a volume by construction and defining thereby a predetermined shape which is continuous and self-sustaining, and which represents the reproduction of a desired three-dimensional item, the function of which is unassociated with the function of a container;

said flexible container being attached to the flexible garment and, upon assuming its predetermined shape, being adaptable to enclose the flexible garment; and closure means for opening and closing the flexible container enabling the flexible garment to be stored within and removed from the flexible container.

4. The three-dimensional flexible container as defined in claim 3, wherein the flexible container is a pocket in the flexible garment.

5. The three-dimensional flexible container as defined in claim 4, wherein the enclosure means is adjustable.

6. The three-dimensional flexible container is defined in claim 5, wherein the closure means comprises a double sided zipper slider.

7. The three-dimensional flexible container as defined in claim 3, further comprising:

at least one carrying strap secured to said flexible container for extending outwardly therefrom upon storage of the flexible garment within the flexible container and for being stored in the flexible container upon removal of the flexible garment from the flexible container.

8. In combination, a flexible garment and a three-dimensional flexible container forming part of the flexible garment which is complete and functional apart from the container, comprising:

at least one flexible forming piece encompassing a volume by construction and defining thereby a predetermined shape which is continuous and self-sustaining, and which represents the reproduction of a desired three-dimensional item the function of which is unassociated with the function of a container;

said flexible container, upon assuming its predetermined shape, being adaptable to enclose the flexible garment;

closure means for opening and closing the flexible container enabling the flexible garment to be stored within and removed from the flexible container.

9. The combination as defined in claim 8, wherein the flexible container is a pocket in the flexible garment.

10. The combination as defined in claim 9, wherein the closure means is adjustable.

11. The combination as defined in claim 10, wherein the closure means comprises a double sided zipper slider.

12. The combination as defined in claim 8, wherein the flexible container further comprises:

at least one carrying strap secured to said flexible container for extending outwardly therefrom upon storage of the flexible container and for being stored in the flexible container upon removal of the flexible garment from the flexible container.

13. In combination, a flexible garment and a reversible, three-dimensional, flexible container attachable to the flexible garment for enclosing the flexible garment when it is not in use, the flexible garment being complete and functional apart from the container, the container comprising:

at least one flexible forming piece having opposed surfaces, said flexible forming piece defining, by construction, a predetermined shape which is continuous and self-sustaining, and which represents the reproduction of a desired three-dimensional item, the function of which is unassociated with the function of a container;

said container assuming its predetermined shape and encompassing said volume by either of said opposed surfaces, and as such being adaptable to enclose the flexible garment.

14. A method of using a container for an article for representing the reproduction of a desired three-dimensional item, comprising the steps of:

forming the container from at least one flexible forming piece to encompass a volume by construction and define thereby a predetermined three-dimensional shape which is continuous and self-sustaining, and which represents the reproduction of the desired three-dimensional item, the function of which is unassociated with the function of a container; and attaching the container so formed to the article.

15. A method of using a container for a garment for representing the reproduction of a desired three-dimensional item, comprising the steps of:

providing at least one flexible forming piece having opposed surfaces;

forming the container from said at least one flexible forming piece to encompass, by either of said opposed surfaces, a volume by construction and define thereby a predetermined three-dimensional shape which is continuous and self-sustaining, and which represents the reproduction of the desired three-dimensional item, the function of which is unassociated with the function of a container; and attaching the container so formed to the garment.

* * * * *